US005878498A

United States Patent [19]

Mundt

[11] Patent Number: 5,878,498

[45] Date of Patent: Mar. 9, 1999

[54] TOOL AND METHOD FOR CUTTING BALE TWINE

[76] Inventor: Louis Henry Mundt, 96 Mundt Rd., Belt, Mont. 59412

[21] Appl. No.: 947,539

[22] Filed: Oct. 11, 1997

[51] Int. Cl.[6] ..... B26B 3/00

[52] U.S. Cl. ..... 30/2; 30/294

[58] Field of Search ..... 30/2, 294, 317

[56] References Cited

U.S. PATENT DOCUMENTS 2,686,969 8/1954 Furey ..... 30/2 X

*Primary Examiner*—Douglas D. Watts

*Attorney, Agent, or Firm*—Michael K. Lindsey

[57] ABSTRACT

A tool and method are provided for manually cutting twine wrapped around a bale. The tool includes a stem having a handle attached to one end and a hook at the other end. The hook opens reversely toward the handle. The hook includes an outer edge sharpened for cutting through ice and twine. The hook also includes an inner dull surface facing toward the handle for selectively engaging the twine upon placing the hook between the bale material and twine. The dull surface permits a user to pull the twine away from the bale without severing the twine. This allows the user to easily grasp the twine in his hand, and then cut the twine using the outer edge of the hook.

18 Claims, 2 Drawing Sheets

TOOL AND METHOD FOR CUTTING BALE TWINE

TECHNICAL FIELD

The present invention relates generally to hand tools for cutting rope or twine, and in particular, to a unique hand tool adapted for cutting bale twine.

Background of the Invention

Bales of hay are typically held together by twine or plastic webbing. However, the use of twine is prevalent throughout North America and most of the world.

Traditionally, bales are rectangular in shape. However, modern agricultural practices have moved away from rectangular bales in favor of "rolled" bales that are cylindrical in shape. A rolled bale is usually five or more feet in diameter and stored with its cylindrical axis horizontal to the ground.

A bale is wrapped with one or more strands of twine to keep it from falling apart. The twine is generally made from plastic or nylon, but can also be made from natural materials such as sisal, cotton, or hemp.

Twine is automatically placed around the bale by a mechanical harvester called a baler. On a rolled bale, the twine is wrapped around the cylindrical circumference of the bale.

Bales are usually fed to livestock. During winter months, bales of hay or other feed material are the primary food source for most domestic herds. Because twine presents a hazard to feeding animals, it must be removed before the bale material is given to the livestock. An animal can be injured by ingesting or becoming entangled in twine.

In many instances, bales are stored outdoors and exposed to winter snow and ice. In northern climates, bales are often covered in six or more inches of snow and ice during winter months. Snow and ice present great difficulty to a rancher trying to remove twine from bales.

Typically; a rancher uses a conventional knife to cut and remove the twine from a bale. However, this method is awkward and clumsy when attempted with ice-covered bales. It is even more awkward when extreme cold prevents the rancher from removing his gloves.

To remove twine from ice-covered bales, the rancher cuts through the ice and twine using his knife and then burrows his gloved fingers under the frozen twine to pull it away from the bale. He must repeat this process for each strand of twine on the bale. A typical rolled bale has six or more stands. This conventional technique results in excessive physical fatigue and many worn out gloves, especially when feeding a large herd.

Therefore, there is a need for an improved twine cutting tool that allows ranchers to easily remove bale twine under winter conditions.

BRIEF DESCRIPTION OF THE DRAWINGS

The invention is pointed out with particularity in the appended claims. However, other features of the invention will become more apparent and the invention will be best understood by referring to the following detailed description in conjunction with the accompanying drawings in which:

DETAILED DESCRIPTION OF A PREFERRED EMBODIMENT

It is an advantage of the present invention to provide a novel tool for cutting twine that significantly reduces the clumsiness and fatigue associated with traditional methods of manually removing twine from bales. An advantage of the present invention is that it conveniently chops through ice. Another advantage of the present invention is that it is easy to manipulate with gloved hands. A further advantage of the present invention is that does not require a user to dig through bale material with his fingers in order to pull the twine away from the bale.

Figure 1:
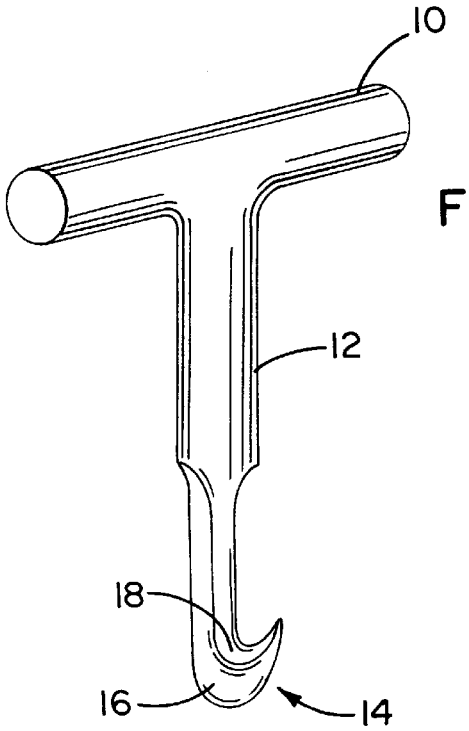
FIG. 1 illustrates a front perspective view of a bale twine knife in accordance with a first embodiment of the present invention.

FIG. 1 illustrates a front perspective view of a bale twine knife in accordance with a first embodiment of the present invention. The bale twine knife comprises a stem 12 having a handle 10 attached to one end and a hook 14 at the other end. The hook 14 opens reversely toward the handle 10.

The hook 14 includes an outer edge 16 sharpened for cutting through ice and twine. The hook 14 also includes an inner dull surface 18 facing toward the handle 10.

A user pulls twine away from the bale using the hook 14. Upon placing the hook 14 between bale material and the twine, the user engages the dull surface 18 to the twine. The inner dull surface 18 permits the twine to be pulled away from the bale without severing the twine. The user can pull the twine sufficiently far away from the bale to easily slip his hand underneath the twine. This allows the user to grasp the twine in his hand, and then cut the twine using the outer edge 16 of the hook 14.

If ice on the bale is too thick to easily pull the twine, the user can remove ice by moving the twine knife vertically along the twine. The knife can be guided by first hooking the twine against the dull surface 18.

Preferably, the handle 10 is attached in a transverse relationship to the axis of the stem 12. The transverse-mounted handle 10 permits the user to apply greater force with less fatigue when chopping through ice and snow. In addition, the transverse handle 10 makes it much easier to manipulate the bale twine knife with gloved hands.

The bale twine knife is preferably made of high grade steel. The handle 10 is welded to the stem 12. The hook 14 is formed by drawing out one end of the stem 12 and then bending the drawn end back toward the stem 12. The sharpened outer edge 16 is formed by grinding the curved portion of the hook 14. The sharpened edge 16 is then tempered to provide a durable cutting edge.

Although the handle 10 is preferrably made of steel and welded to the stem 12, it can also be made of other materials, such as plastic or wood, and fastened to the stem 12 using other means, such as press fitting, bolting, or riveting.

Figure 2:
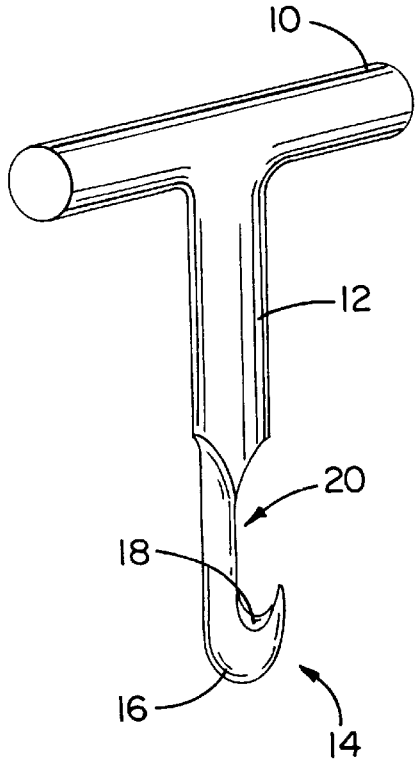
FIG. 2 illustrates a front perspective view of a bale twine knife in accordance a second embodiment of the present invention.

FIG. 2 illustrates a front perspective view of a bale twine knife in accordance a second embodiment of the present invention 3. In this embodiment, the stem 12 includes a forward facing sharpened edge 20 for cutting the twine. The forward facing edge 20 is located above the inner dull surface 18 and below the handle 10.

Figure 3:
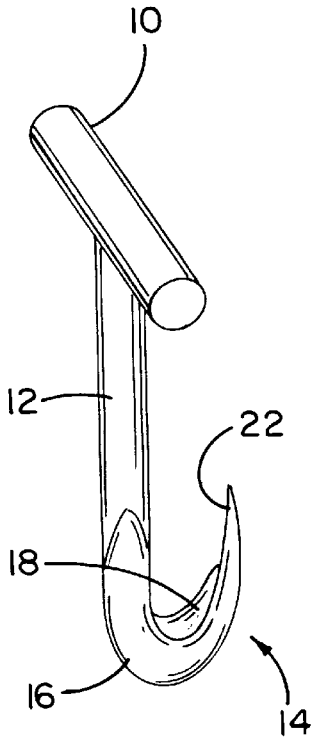
FIG. 3 illustrates a rear perspective view of a bale twine knife in accordance a third embodiment of the present invention.

FIG. 3 illustrates a rear perspective view of a bale twine knife in accordance a third embodiment of the present invention 9. In this embodiment, the hook 14 includes an inwardly facing sharpened edge 22 for cutting the twine. The inwardly facing edge 22 is located near the tip of the hook 14, and above the inner dull surface 18.

Figure 4:
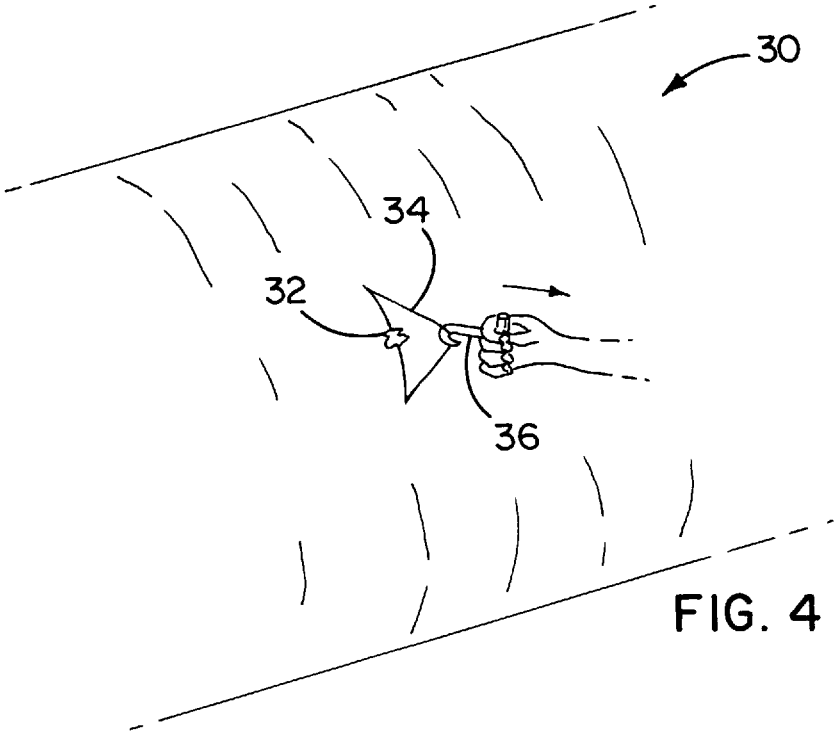
FIGS. 4–5 illustrate a technique of cutting bale twine using any of the embodiments of the bale twine knife shown in FIGS. 1–3.
Figure 5:
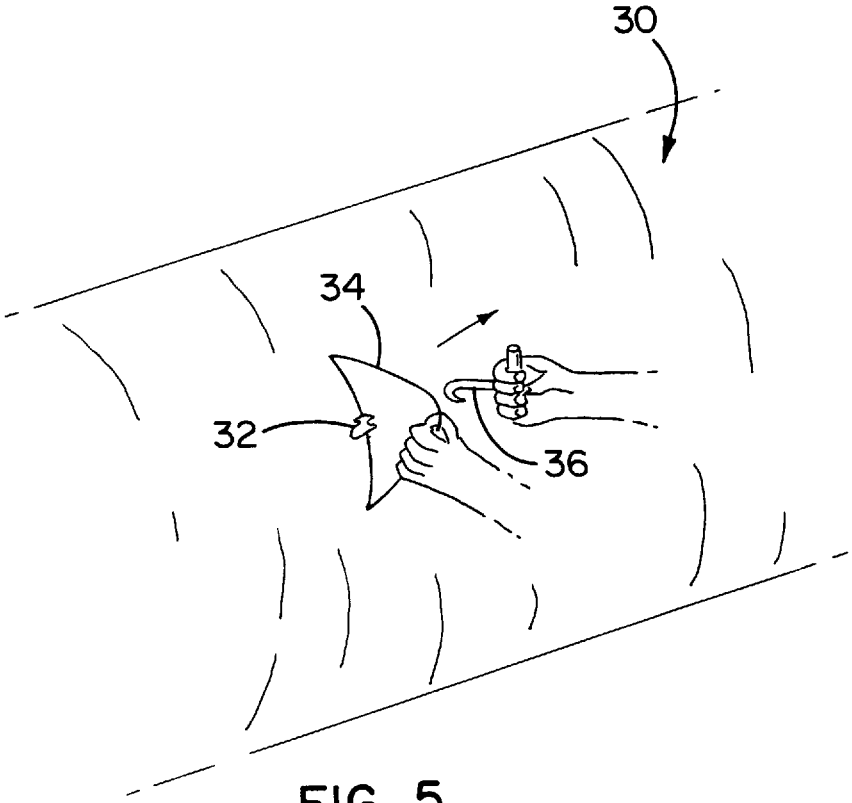

FIGS. 4–5 illustrate a technique of cutting bale twine using any of the embodiments of the bale twine knife shown in FIGS. 1–3. As shown in FIG. 4, the user first cuts a hole 32 through ice covering the bale 30 using the sharpened outer edge 16 of the bale knife 36. Upon exposing the twine 34, the user hooks the twine 34 against the dull surface 18 of the knife 36, and then pulls the twine 34 away from the bale 30. Generally, there is enough give in the bale material to allow the twine 34 to pulled far enough from the bale 30 to allow the user to grasp the twine 34 with his other hand, as shown in FIG. 5.

FIG. 5 shows the user cutting the twine 34 with the outer edge 16 of the bale twine knife 36. Grasping the twine 34 in one hand, the user unhooks the knife 36, and then slashes the twine 34 using the sharpened outer edge 16.

The bale twine knife provides a significant advantage over prior art tools because it requires only one hand to do two different functions—cutting through ice and pulling twine away from the bale. This frees the user's other hand to hold previously cut twine. Having a free hand to hold cut twine is especially advantageous when cutting multiple strands of twine. It lessens the chance of losing cut twine in the bale material, where it presents a hazard to livestock.

In conclusion, there has been described herein a concept, as well as a preferred embodiment, of a tool and method that can be used to manually cut bale twine. Combining a hooked-end, dull surface and sharpened edge into a single tool provides an improved implement that greatly reduces the effort required to cut twine from a bale. Moreover, because the various embodiments of the tool utilize a hooked-end with a sharpened outer edge, they can cut through ice which allows a user to conveniently remove bale twine during the winter months.

Furthermore, the transverse-mounted handle permits the user to apply greater force with less fatigue when chopping through ice and snow. The transverse handle also improves the user's ability to manipulate the tool with gloved hands.

While specific embodiments of the present invention have been shown and described, it will be apparent to those skilled in the art that the disclosed invention may be modified in numerous ways and may assume many embodiments other than the preferred form specifically set out and described above.

Accordingly, it is intended by the appended claims to cover all modifications of the invention which fall within the true spirit and scope of the invention.

What is claimed is:

1. A tool for cutting twine wrapped around a bale, comprising:

a handle;

a stem mounted to the handle in a generally perpendicular orientation, the stem having a hook-shaped end opening reversely toward the handle, the hook-shaped end having a sharpened outer edge and an inner dull surface facing toward the handle for selectively engaging the twine upon placing the hook between bale material and the twine, the inner dull surface permitting the twine to be pulled away from the bale without severing the twine, whereby allowing a user to easily grasp the twine in hand and then cut the twine using the sharpened outer edge.

2. The tool as recited in claim 1, wherein the stem includes an forward facing sharpened edge, located above the inner dull surface, for cutting the twine.

3. The tool as recited in claim 1, wherein the sharp edge is located below the handle and above the hook-shaped end.

4. The tool as recited in claim 1, wherein the hook-shaped end includes an inwardly facing sharpened edge located above the inner dull surface, for cutting the twine.

5. A tool for cutting twine wrapped around a bale, the tool comprising a stem having a handle attached to one end and a hook at the other end opening reversely toward the handle, the hook including a sharpened outer edge and an inner dull surface facing toward the handle for engaging the twine, the inner dull surface permitting the twine to be pulled away from the bale without severing the twine.

6. The tool as recited in claim 5, wherein the handle is attached in a generally transverse relationship to the axis of the stem.

7. The tool as recited in claim 5, wherein the outer edge is curved.

8. The tool as recited in claim 5, wherein the dull inner surface is curved.

9. The tool as recited in claim 5, wherein the hook includes an inwardly facing sharpened edge, located above the inner dull surface.

10. The tool as recited in claim 5, wherein the stem further includes a second sharpened edge located below the handle and above the dull surface.

11. The tool as recited in claim 10, wherein second sharpened edge is substantially co-planar with the outer sharpened edge of the hook.

12. A bale twine knife for manually cutting twine, comprising:

a stem having a first end and a second end;

a handle attached to the first end in generally transverse relationship to the stem; and a hook-shaped blade at the second end of the stem curved toward the first end, the hook-shaped blade having an outer sharp edge and an inner dull surface.

13. A method of manually cutting twine wrapped around a bale, comprising the steps of:

providing a tool for manually cutting twine, the tool comprising a stem having a handle attached to one end and a hook at the other end opening toward the handle, the hook including an outer edge sharpened for cutting the twine and an inner dull surface for selectively engaging the twine;

placing the hook between bale material and the twine;

engaging the twine with the dull surface;

using the tool to pull the twine away from the bale without severing the twine;

grasping the twine; and cutting the twine using the outer edge of the hook.

14. The method of claim 13, further comprising the step of:

cutting through ice disposed on the bale using the outer curved edge of the hook.

15. The tool of claim 5, wherein the inner dull surface is capable of engaging the twine upon placing the hook between bale material and the twine.

16. The bale twine knife of claim 12, wherein the outer sharp edge is capable of cutting through ice.

17. The bale twine knife of claim 12, wherein the outer sharp edge is capable of cutting the twine.

18. The bale twine knife of claim 12, wherein the inner dull surface permits a user to manually pull the twine away from the bale without severing the twine.

* * * * *